US005431229A

United States Patent [19]

Christensen

[11] Patent Number: 5,431,229

[45] Date of Patent: Jul. 11, 1995

[54] METHOD AND APPARATUS FOR UTILIZING THE PRESSURE OF A FLUID COLUMN GENERATED BY A PUMP TO ASSIST IN RECIPROCATING THE PUMP PLUNGER

[75] Inventor: Bryon D. Christensen, Calgary, Canada

[73] Assignee: Reaction Oilfield Products Ltd., Calgary, Canada

[21] Appl. No.: 181,212

[22] Filed: Jan. 13, 1994

[51] Int. Cl.[6] ..... F21B 43/00; F04B 47/12

[52] U.S. Cl. ..... 166/369; 166/105.2; 417/259; 417/434

[58] Field of Search ..... 166/105, 105.2, 112, 166/369; 417/259, 260, 434, 554

[56] References Cited

U.S. PATENT DOCUMENTS

| | | | |
|---|---|---|---|
| 206,956 | 8/1878 | Lytle | 166/112 |
| 767,454 | 8/1904 | Taylor . | |
| 1,549,175 | 8/1925 | Adams et al. . | |
| 1,717,619 | 6/1929 | Neilson et al. . | |
| 1,844,261 | 2/1932 | Penrod . | |
| 2,067,774 | 1/1937 | Matthews et al. . | |
| 2,160,811 | 6/1939 | Adams . | |
| 2,624,288 | 1/1953 | Reilly . | |
| 2,684,639 | 7/1954 | Sutton | 417/260 |
| 3,140,667 | 7/1964 | Anderson et al. . | |
| 3,267,872 | 8/1966 | Bloodoff . | |
| 3,479,958 | 11/1969 | Anderson et al. . | |
| 3,689,206 | 9/1972 | Meripol . | |
| 3,912,420 | 10/1975 | Gault . | |
| 3,918,845 | 11/1975 | Heard . | |
| 3,945,774 | 3/1976 | Doan | 417/554 |
| 4,047,853 | 9/1977 | Huckaby . | |
| 4,219,311 | 8/1980 | Simon . | |
| 4,425,083 | 1/1984 | Peterson et al. | 417/554 |
| 4,557,668 | 12/1985 | Jones . | |
| 4,596,515 | 6/1986 | Simon et al. . | |
| 4,673,338 | 6/1987 | Jones | 417/554 |
| 4,867,242 | 9/1989 | Hart . | |
| 4,968,226 | 11/1990 | Brewer . | |
| 5,141,416 | 8/1992 | Cognevich et al. . | |

*Primary Examiner*—Ramon S. Britts
*Assistant Examiner*—Frank S. Tsay
*Attorney, Agent, or Firm*—Bennett Jones Verchere

[57] ABSTRACT

The apparatus provides both a novel reciprocating pump for pumping fluid from a source by forming and moving a fluid column within a tubing and a method of using the pump. The pump, which is particularly suited for oil wells, uses the pressure generated by the fluid column to increase the downward force acting on the pump plunger during the downstroke. The pump is provided with a reciprocable first surface which is in contact with the fluid column, a second surface which moves with the first surface and has a smaller cross-sectional area than the first surface, valve means cooperating with the second surface for subjecting the second surface to fluid at the pressure of the fluid at the source in the vicinity of the pump during movement in one direction and to fluid at the pressure of the fluid column in the vicinity of the pump during movement in the opposite direction. The magnitude of the downward force can be affected by regulating one or both of the pressure of the fluid column and the pressure of the fluid in the source.

20 Claims, 2 Drawing Sheets

METHOD AND APPARATUS FOR UTILIZING THE PRESSURE OF A FLUID COLUMN GENERATED BY A PUMP TO ASSIST IN RECIPROCATING THE PUMP PLUNGER

FIELD OF INVENTION

This invention relates to a pump for pumping in a liquid filled environment. In a particular preferred embodiment this invention is directed to a mechanical downhole pump for use in oil wells and the like.

BACKGROUND OF THE INVENTION

A typical oil well comprises a cylindrical well casing, a concentric production tubing which is narrower in diameter than the casing and which is lowered within the casing, and a pump located at the lower end of the production tubing, which is submerged below the fluid level in the casing.

A conventional type of pump used in many wells has a barrel connected to the production tubing below the level of the oil in the well casing, a standing (inlet) valve located proximate to the bottom of the barrel, a plunger reciprocated within the barrel, and a travelling (or outlet) valve. The travelling valve is usually associated with, and actuated by, the plunger.

In operation the plunger is reciprocated, as for example by a string of sucker rods which is reciprocated from apparatus at the surface, such as a pumpjack. As the plunger is lifted, the travelling valve is forced closed, which tends to create a vacuum in the barrel beneath the plunger. This forces the standing valve open, whereby oil in the casing is drawn into the barrel. When the plunger descends, the standing valve closes, the travelling valve opens, and oil in the barrel is forced to pass through the travelling valve into the production tubing above the plunger. As the plunger is reciprocated through a series of upstrokes and downstrokes, oil within the oil well casing is forced into the production tubing, producing a column of oil in the tubing above the plunger. Eventually this column reaches the surface, whereupon each subsequent cycle of the plunger pumps a volume of oil (equal to the volume within the barrel displaced by the movement of the plunger) to the surface.

Due to the long length of the string of sucker rods, the total elasticity of the string of rods is very large. This causes stretching of the string during the upstroke, and compression or buckling of the string during the downstroke. This reduces the effective downward force acting on the plunger when it is moving downwardly in the barrel, since some of this force is absorbed within the string of rods. In many wells the lowering of the rods is further impaired by obstructions in the well and by the viscosity of oil.

Thus, in many wells, depending on such factors as the depth and vertical orientation of the well, and the viscosity of the oil being pumped, the downward force acting on the plunger during the downstroke is insufficient to force the plunger to traverse the pump barrel fully, reducing the productive capacity of the pumping system, and underutilizing the reciprocating action of the pumpjack or other surface apparatus. Further, the sucker rods can wear or become damaged from the buckling, especially if they are of glass fibre or composite material.

The fluid in the production tubing constitutes a long fluid column, often thousands of meters in height.

Therefore, there is a pressure (hereafter referred to as the "tubing pressure") on the plunger (which is at the bottom of that column) from the weight of the fluid above it. However, during the downstroke in a conventional pump, this pressure acts on both sides of the plunger (because the travelling valve is open and the standing valve is closed during the downstroke). Thus there is no net downward force on the plunger arising from the weight of the fluid column during the downstroke in a conventional pump, despite the fact that the tubing pressure is greater (and often substantially greater) than the "casing pressure" (the pressure of fluid in the casing in the vicinity of the pump).

There have been various attempts to make use of the weight of the fluid in the production tubing to force the plunger downward.

U.S. Pat. No. 3,140,667 issued to Robert L. Anderson et. al. in 1964 discloses an apparatus which attempts to overcome this problem by using a subsurface pump which embodies two barrels and two plungers of the same cross section and two annular sections separated by an annular packing assembly. During the downstroke oil is drawn from the casing into one of the annular sections. On the upstroke it is forced from this annular region into the production tubing.

U.S. Pat. No. 3,918,845 issued Nov. 11, 1975 to Allen Heard and U.S. Pat. No. 3,912,240 issued Oct. 14, 1975 to Robert H. Gault both disclose pumps which have dual plungers reciprocating within dual barrels with three valves and a central packing assembly for dividing the barrel into two regions, one above, and the other below the packing. Each region is divided again by its respective plunger assembly. Both of these patents provide for fluid between the packing and the top plunger to be in communication with fluid at the casing pressure to produce a net downward force, while the oil in the lower chamber is sealed off by means of the said packing. Oil is first pumped into the region below the lower plunger during one stroke, and then into the region between the lower plunger and the packing during the next stroke before being forced into the production tubing during the subsequent stroke.

All three of these patents disclose pumps utilizing at least 3 packing seals, each of which are subject to wear. Furthermore, these pumps are complex in construction and involve a central packing assembly which complicates withdrawal of the plungers when the packing seals wear. There exists a need for an effective downhole pump of simple construction which utilizes the pressure of the fluid column to produce a net downward force during the downstroke.

SUMMARY OF THE INVENTION

The invention provides both an apparatus and a method for keeping the string of sucker rods under tension and increasing the downward force acting on the pump plunger during the downstroke. This is accomplished by a novel pump having a first surface which is always in contact with fluid at the tubing pressure, and a second surface which moves with the first surface and is of a smaller cross-sectional area than the said first surface. The second surface is subjected to the casing pressure during the upstroke and is subjected to the tubing pressure during the downstroke. The said two surfaces may be on two separate plungers which are connected to reciprocate together, or may be opposing surfaces of one plunger having a T-shaped cross section.

In a preferred embodiment, two differently sized, axially aligned barrels are provided. The larger barrel connects with the bottom of the production tubing at one end, and receives the smaller barrel towards the other end. The bottom of the smaller barrel is provided with a standing valve. A first plunger is sized to reciprocate sealably within the first barrel, with the upper face or surface of the plunger acting as the first surface. As the plunger reciprocates within the first barrel, the plunger varies the volume within the first barrel below the said plunger. The first barrel is provided with vent holes to the casing to equalize the pressure of the fluid in the barrel below the first plunger with the pressure of the fluid in the casing surrounding the barrel. An array of holes may be utilized.

A travelling valve is associated with the first plunger. The first plunger is hollow with a channel leading from the travelling valve to a tube which extends towards a second, smaller diameter plunger. The second plunger is sized to reciprocate sealably within the second barrel. The tube connects the second plunger to the first plunger, so that the two plungers reciprocate together. The second plunger varies the volume within the said second barrel below the second plunger. The second plunger's lower surface acts as the second surface.

In a second embodiment, the two plungers are replaced with a single plunger having a cylindrical upper section with an elongated coaxial cylindrical lower section of smaller diameter such that the two are T-shaped in cross-section. The upper section of the plunger is sized to reciprocate sealably within the first barrel and its top surface acts as the first surface. The elongated lower section of the plunger is sized to reciprocate sealably within the second barrel, and its lower surface acts as the second surface.

The invention produces a net downward force acting on the plunger assembly and sucker rods during the downstroke. The magnitude of this force depends on the difference in cross-sectional areas between the first surface and the second surface, and also depends on the difference in pressure between the tubing pressure and the casing pressure.

The invention provides a method of regulating the size of the downward force directly from the surface without having to withdraw the sucker rod string or the production tubing. This is accomplished by regulating the pressure within the casing, or within the production tubing, or both. By increasing the pressure within the production tubing (ie, the tubing pressure), the net downward force acting on the pump plunger can be increased. By increasing the pressure within the well casing, the net downward force acting on the pump plunger can be decreased.

Accordingly, in a broad aspect, the invention includes an apparatus for pumping fluid from a source by forming and moving a fluid column within a tube by means of a reciprocating action, said apparatus comprising a reciprocable first surface, said first surface in contact with fluid at the tubing pressure; a second surface which moves with the first surface, said second surface having a smaller cross-sectional area than the said first surface; and valve means cooperating with said second surface for subjecting the second surface to the casing pressure during the upstroke and to the tubing pressure during the downstroke.

These foregoing aspects of the invention, together with other aspects and advantages thereof will be more apparent from the following description of the preferred embodiments thereof, taken in conjunction with the following drawings.

DETAILED DESCRIPTION OF THE INVENTION

Figure 1:
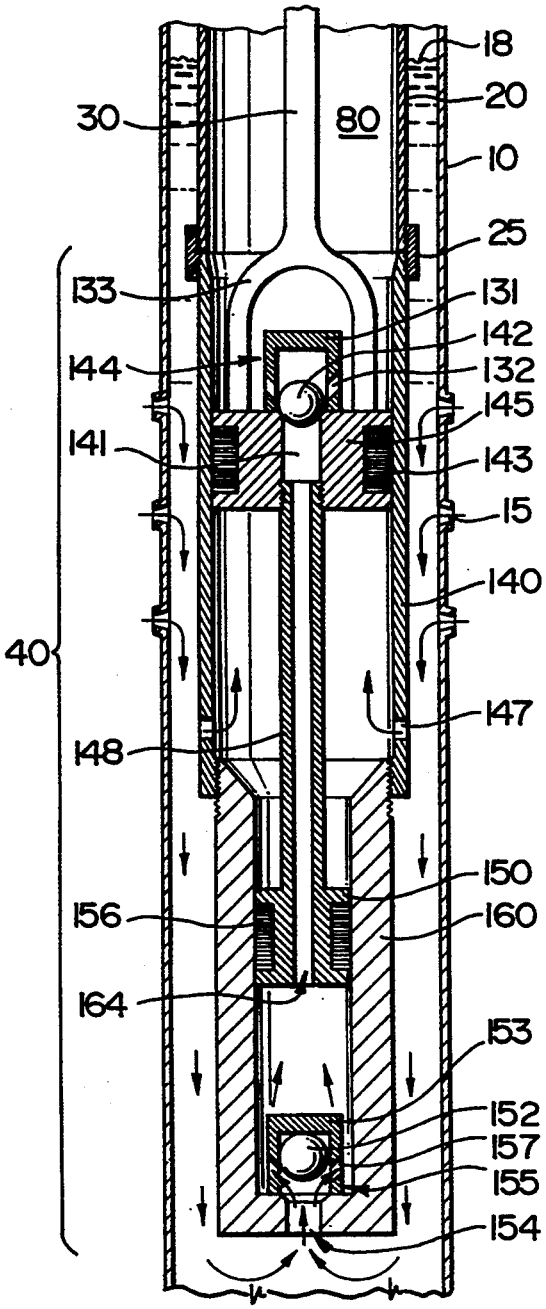
FIG. 1 is a schematic cross section through a portion of an oil well showing a downhole pump of the invention during its upstroke.

In the following description, directional descriptions such as up, down, etc, are in reference to the orientation of the embodiments as shown in the drawings, and should not be taken as absolute limitations. In particular, it should be noted that there is no limitation in the present invention for the pump to be vertically oriented, although it is shown that way for ease of illustration.

FIG. 1 shows a schematic view of a pump, in accordance with a preferred embodiment of the invention, located in a conventional oil well. Only the parts necessary to illustrate operation are shown, and the drawing is not drawn to scale.

Conventional oil well casing 10 extends into the ground to reach an oil bearing stratum. Oil well casing 10 has casing perforations 15 so that oil from the oil bearing stratum may seep through the perforations to fill the casing up to level 18.

Suspended within the casing is the production tubing 20, comprising a string of hollow tubes coupled together, extending from the surface to below the level of the oil 18.

Apparatus such as, for example a pumpjack, (not shown) located at the surface reciprocates a string of sucker rods 30 within the production tubing 20. The inventive pump, generally indicated as 40, is coupled to the bottom of the production tubing in any suitable manner. It replaces the conventional pump usually placed in that position.

In the embodiment shown, pump barrel 140 is attached to production tubing 20 in a conventional manner, as by coupler 25. A first plunger 145, with associated channel 141 and ball 142 forming travelling valve 144, is connected to sucker rods 30 via attachment 133. Cage 131, which constrains ball 142, has valve vent 132 to enable fluid to pass through the valve when the valve is open. Seal 143, which may be an O-ring or other sealing mechanism as is known in the art, may optionally surround plunger 145 to make a tight sliding seal between plunger 145 and barrel 140. The top surface of plunger 145 is continuously subject to the tubing pressure in the production tubing 20 (hereafter called the "tubing pressure").

Axially aligned smaller pump barrel 160 extends from the lower extreme of barrel 140. Barrel 160 is received into barrel 140 and connected by means of mating threads. The bottom of pump barrel 160 is provided with an inlet (also known as a "standing") valve 155, having a channel 154 which can be sealed by ball 152. Ball 152 is retained in the vicinity of channel 154 by cage 153, which has vents 157 for allowing fluid passage. For both valves 155 and 144, any suitable valve can be used, and a ball valve is shown for illustration only.

A second plunger 150 is sized to reciprocate within pump barrel 160. Plunger 150 may incorporate O-rings or packing 156 in order to form a good sliding seal with barrel 160. Plunger 150 is pierced by channel 164. Hollow piston rod 148 connects plunger 150 to plunger 145 in such a manner as to accomplish two objects: first, to connect channel 141 of plunger 145 with channel 164 of plunger 150 so that fluid may flow freely from one channel to the other, but not into the portion of barrel 140 between the two plungers, and second to cause plungers 145 and 150 to move together.

In the preferred embodiment, rod 148, plunger 150 and channel 164, small pump barrel 160, plunger 145 and channel 141, barrel 140, and sucker rods 30 are all axially aligned, sharing a common central axis.

Barrel 140 is perforated with vent holes 147 in order to allow fluid flow between the interior of barrel 140 and the annular region between barrel 140 and casing 10. Vent holes 147 are located below the limit of travel of plunger 145 so that the bottom surface of plunger 145 is subject to the same pressure as fluid in the annular space between casing 10 and production tubing 20 in the vicinity of pump 40 (ie, the casing pressure).

In operation sucker rods 30 are reciprocated by the above-ground apparatus (not shown). The operation during the upstroke will first be described. This is illustrated in FIG. 1. As rod 30 is pulled up plunger 145 is pulled upwards forcing ball 142 to seal channel 141, closing travelling valve 144. The entire fluid column 80 is then supported and lifted by plunger 145 and valve 144.

As plunger 145 rises, rod 148 and connected plunger 150 are pulled up with it. As plunger 145 is raised, a vacuum tends to form within pump barrel 140 forcing fluid from within casing 10 to enter through vent holes 147 to fill the void. Therefore pump barrel 140, underneath plunger 145, fills with fluid at the casing pressure.

The upward motion of plunger 150 also tends to produce a vacuum within pump barrel 160 because travelling valve 144 is closed, and hence hollow rod 148 is sealed, during the upstroke. The vacuum forces standing valve 155 to open and fluid within casing 10 to enter through channel 154. Therefore, the portion of pump barrel 160 below plunger 156 and rod 148 are filled with fluid at the casing pressure.

Figure 2:
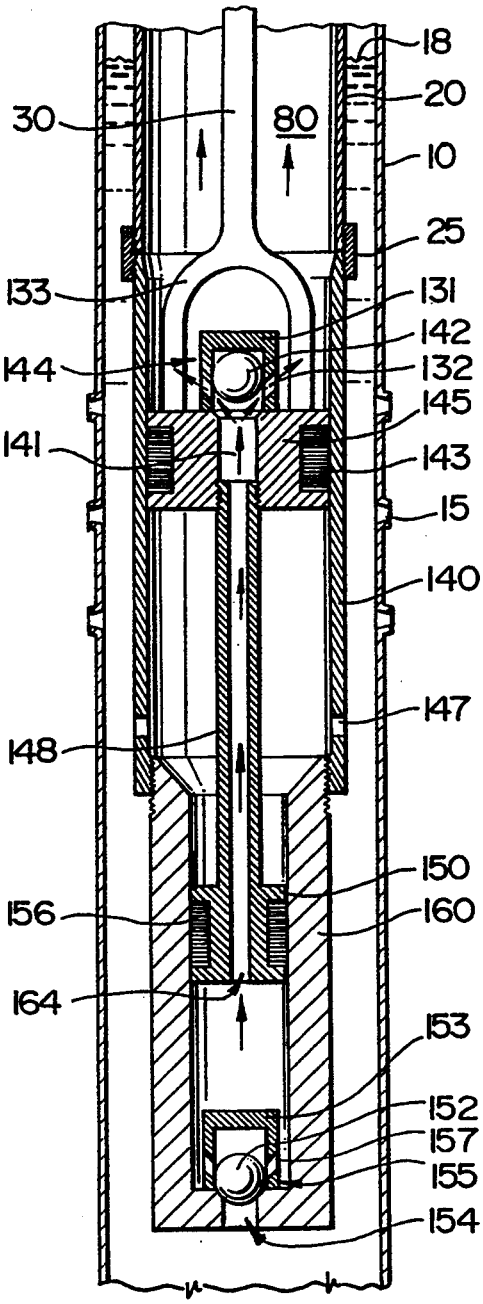
FIG. 2 is a schematic cross section as in FIG. 1, but showing the pump during its downstroke.

The operation during the downstroke is shown in FIG. 2. Plunger 145 is lowered into pump barrel 140 by descending sucker rods 30. This simultaneously lowers plunger 150 which tends to increase the pressure within barrel 160, closing standing valve 155. This increases the fluid pressure within rod 148, forcing travelling valve 144 to open. As plunger 150 descends fluid is forced from barrel 160 through channel 164 into rod 148 and then through open travelling valve 144 into production tubing 20. With standing valve 155 closed and travelling valve 144 open, the fluid pressure within small pump barrel 160 and rod 148 is equal to the tubing pressure. As plunger 145 descends, fluid within large pump barrel 140 is forced out through vent hole 147 into casing 10. Therefore, the pressure within the portion of the pump barrel 140 below the plunger 145 will remain the same as the casing pressure (plunger 145 does not descend sufficiently to block vent holes 147).

In most wells, the tubing pressure is greater than the casing pressure, because the column 80 of fluid within the production tubing is higher than the column of fluid between the casing and the production tubing. During the upstroke, the fluid in contact with the bottom of plunger 145 and in contact with the top and bottom of plunger 150 are all at the casing pressure (which can be considered as constant over the distance between plungers 145 and 150). There is therefore no net pressure resisting movement of plunger 150. The only net pressure difference to be overcome is on the two sides of plunger 145. As with a conventional pump, work must be done to overcome this pressure difference in order to lift the fluid column 80 and pump fluid from the well.

During the downstroke, the situation in the novel pump is very different from that in a conventional pump. In a conventional pump, the pressure on the top and bottom of the plunger is the same during the downstroke, because the travelling valve is open during the downstroke. In the pump of the present invention, plunger 145 has a larger surface area than plunger 150. The pressure on the top surface of plunger 145 and on the bottom surface of plunger 150 is equal, being the tubing pressure. However, the area of the top surface of plunger 145 is larger than that of the bottom surface of plunger 150, so the total force exerted on the top surface of plunger 145 exceeds that on the bottom surface of plunger 150, causing a net downward force which aids the downstroke.

The casing pressure also exerts force on the bottom surface of plunger 145 and on the top surface of plunger 150. As the surface of plunger 145 is larger than that of plunger 150, this force tends to oppose the downstroke. However, the casing pressure is less than the tubing pressure, so the net force exerted by the tubing pressure in the downward direction is greater than the net force exerted by the casing pressure in the upward direction. Thus, there is a net downward force during the downstroke.

It can be seen that the net downward force can be affected by manipulating the pressure within the tubing and within the casing. These pressures can be regulated from the surface in existing oil wells. Therefore the magnitude of the downward force can be increased by increasing the difference in pressures within the tubing and casing (by increasing the tubing pressure and/or decreasing the casing pressure). Similarly, the magnitude of the downward force can be decreased by decreasing the difference in pressures within the tubing and casing (by decreasing the tubing pressure and/or increasing the casing pressure). This method has the considerable advantage of being able to regulate the effectiveness of the downhole pump without having to withdraw the entire apparatus to the surface. Of course, the size of the force on the downstroke of the pump can also be changed by altering the relative sizes of the plungers and their corresponding barrels, but this requires the removal of the pump.

The novel pump, and method of regulating the pressures to control the resulting downward force, can be used in a deviated well with a lower portion which deviates from the vertical, since the pump can still pump fluid in the non-vertical portion of the well. This can permit increased production in some wells, since fluid located below the setting depth of the conventional pump, (ie, the lowest nearly vertical portion) can now be reciprocally pumped from the surface.

It can be seen that the preferred embodiment shown in FIGS. 1 and 2 can be constructed easily by modifying two conventional pumps of different diameters. The larger diameter pump is mounted directly to the production tubing. However, the bottom of the pump with the standing valve is removed. The smaller diameter pump (including its standing valve and barrel) is mounted to the bottom of the larger barrel below the limit of travel of the plunger in the larger barrel. The two plungers are connected by a hollow rod as shown and described, so that they reciprocate together and permit fluid flow between the two valves. The barrel of the larger pump is further modified by providing vent holes in its lower portion to allow the free passage of fluid in and out of the large barrel. Alternately, vent holes can be located in the coupling between the barrels or at the top of the barrel of the smaller pump, so long as the holes are located below the limit of travel of the plunger of the larger pump and above the smaller plunger. Alternately, an array of holes, some of which are covered as the plunger of the larger pump descends, can be used in order to slow the plunger and in order to cause gas evolution, as discussed below with respect to FIG. 4.

Figure 3:
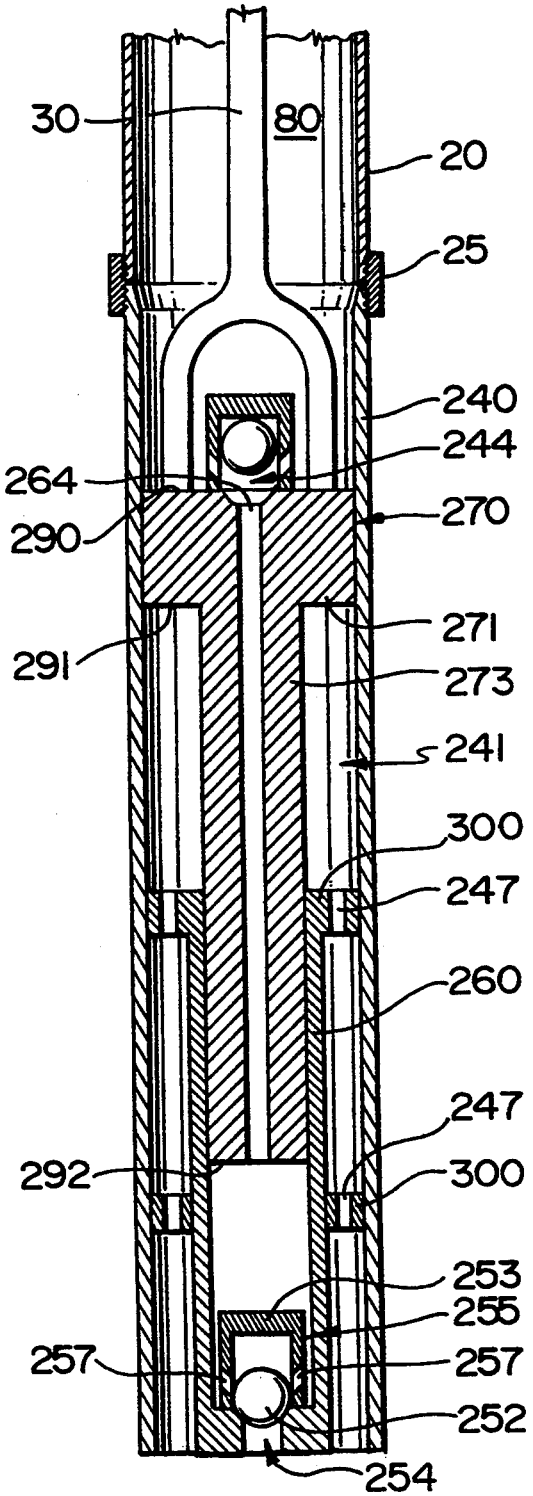
FIG. 3 is a schematic view of an alternative embodiment of the invention.

Another embodiment is shown in FIG. 3. For simplicity, casing 10 is not shown in FIGS. 3 or 4, as it is the same as in FIGS. 1 and 2. Barrel 240 is attached to the tubing 20 in a conventional manner, as by coupling 25. It is open at its lower end. One or more annular brackets 300 are attached, conveniently by mating threads, to the inner wall of barrel 240. Brackets 300 are adapted to receive and support an inner barrel 260 within barrel 240. Barrel 260 is open at its upper end and is provided with a standing valve 255 (which comprises channel 254, sized to receive ball 252) at its lower end. Ball 252 is retained in the vicinity of channel 254 by cage 253, which has vents 257 for allowing fluid passage. Any other suitable standing valve could be used. Brackets 300 are pierced with passages 247 leading from the lower surface of bracket 300 to the upper surface of bracket 300. More than one bracket 300 can be used if desired so that barrel 260 will be held rigidly. In the drawing, two such brackets 300 are shown, but more could be provided if desired. If sufficiently strong materials are used, a single bracket could be used.

Plunger 270 is connected to sucker rods 30 in the usual manner. Plunger 270 is pierced with channel 264 (which extends from the face 290 (first surface) to face 292 (second surface)) with associated travelling valve 244. Plunger 270 has a first cylindrical plunger portion 271 fitting within barrel 240 and an axially elongated cylindrical second plunger portion 273 extending centrally from the bottom thereof and fitting within barrel 260. The region 241 within barrel 240 above bracket 300 and below plunger 271 is filled with fluid at the same pressure as the casing pressure due to ports 247 allowing a free flow of fluid therebetween.

In operation plunger 270 is raised by sucker rods 30 in the normal manner. This closes travelling valve 244 and forces standing valve 255 to open. Fluid then enters barrel 260 through channel 254 and enters cavity 241 through vent ports 247. During the downstroke travelling valve 244 opens and standing valve 255 closes causing the descending plunger 273 to force fluid out of barrel 260 through channel 264 into production tubing 20.

A simplified analysis of forces readily shows that there is a net downward force from the tubing pressure during the downstroke. During the downstroke, there is tubing pressure on face 290 and on face 292 (as valve 255 is shut and valve 244 is open), but only casing pressure on face 291. The force on face 292 offsets the portion of the force on the face 290 which acts on an area of equal size to face 292, since both faces are subject to the same pressure (ie, the tubing pressure). As face 290 has the same area as faces 291 and 292 combined, the force on face 290 exceeds that on the other two faces by the difference in area of faces 290 and 292 (ie, the area of face 291), multiplied by the difference in pressure between the casing and tubing pressures. This analysis does not take into account differences in pressure arising from the height of the plunger or from the downward moving plunger displacing fluid, but these are inconsequential in comparison to the difference between casing pressure and tubing pressure in most wells.

The magnitude of this force during both the upstroke and the downstroke can be regulated by regulating the difference between the tubing and casing pressures, as was discussed with the embodiment of FIGS. 1 and 2.

Figure 4:
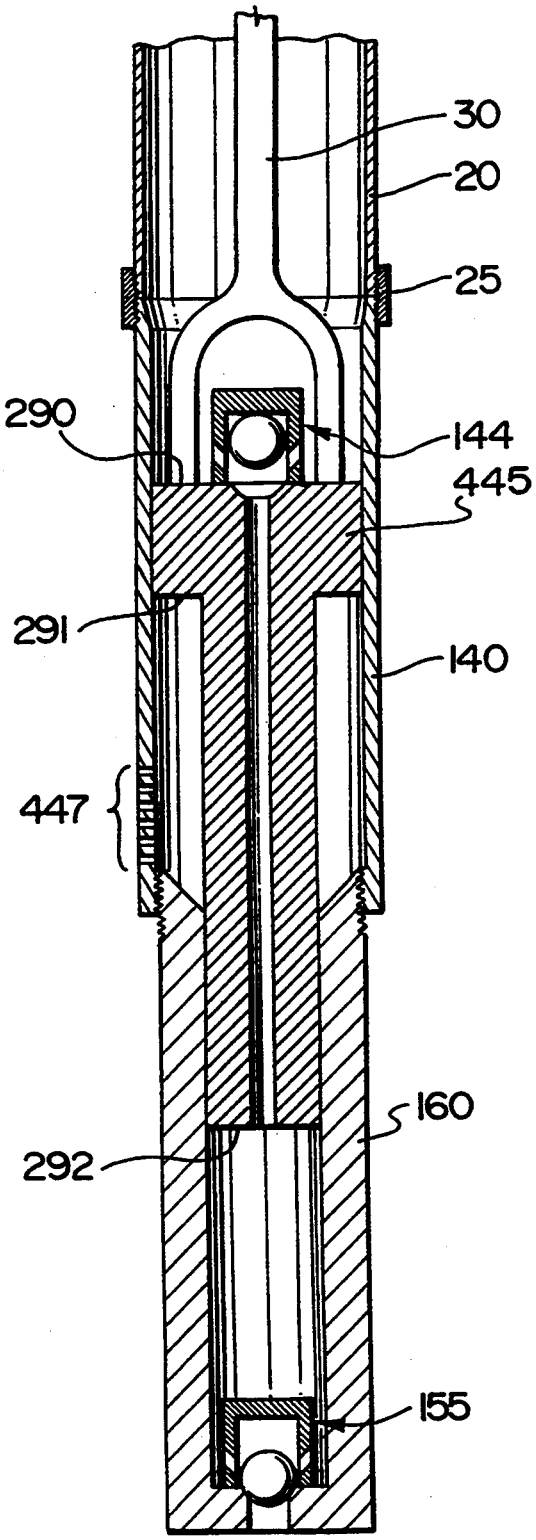
FIG. 4 is a schematic view of a further alternative embodiment of the invention.

The plunger assembly of FIG. 3 can be used with the barrel arrangement of FIGS. 1 and 2. FIG. 4 shows a modified form of such an embodiment, in which vent pods 147 are replaced with an axially aligned series of pods 447. The remaining numbers denote the same pads as in the previous drawings. The array is located close to the limit of travel of face 291 so that at least a portion of a vent hole remains uncovered by the plunger at the bottom of its stroke, but none of the vent holes open into the area above the plunger at any time. As the plunger 445 descends, the pods are successively blocked, making it progressively more difficult for liquid to escape easily from under face 291. This creates a back pressure which slows the descent of the plunger. This is a desirable effect in many wells because the exact distance of travel of the plunger assembly cannot be precisely controlled because of the elastic nature of the sucker rod string. Also, in many wells, these pods tend to reduce gas lock. The passage of some of the casing fluids in and out of these pods create a shear and vacuum condition which tends to cause dissolved gasses to be released into the casing instead of interfering with pump operation.

The embodiments shown in FIGS. 1, 2, and 3 can also be modified to include such an array of holes.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. An apparatus for pumping fluid from a source by forming and moving a fluid column within a tubing by means of a reciprocating action, said apparatus comprising:

a first pump barrel;

a second pump barrel which has a smaller internal diameter than said first pump barrel;

port means for allowing fluid flow between said first pump barrel and said source;

plunging means, adapted to be reciprocated by said reciprocating action, including a first plunger portion sized so as to be able to reciprocate sealably within said first pump barrel, said first plunger portion including a first surface which is in contact with the fluid of said fluid column so as to be continuously subject to the pressure of the fluid column, and a second plunger portion sized so as to be able to reciprocate sealably within said second pump barrel, said second plunger portion including a second surface; and valve means for allowing communication between the second surface and fluid from the source, thus subjecting the second surface to the pressure exerted by the fluid at the source during movement of said plunging means in one direction and for allowing communication between the second surface and fluid from the fluid column, thus subjecting the second surface to the pressure exerted by the fluid column during movement of said plunging means in the opposite direction.

2. The apparatus as claimed in claim 1, wherein said first plunger portion comprises a first plunger and wherein said second plunger portion comprises a second plunger; and wherein said apparatus further comprises means for connecting said first plunger and said second plunger so that the two plungers reciprocate together;

wherein said valve means comprises a standing valve associated with said second barrel and a travelling valve associated with one of said first plunger, said second plunger, and said means for connecting.

3. The apparatus as claimed in claim 2, wherein said first plunger is provided with a first channel for allowing fluid to flow through said first plunger, said second plunger is provided with a second channel for allowing fluid to flow through said second plunger; said first and second channels linked by said means for connecting so that fluid can flow from one channel to the other.

4. The apparatus as claimed in claim 1, wherein aid first plunger portion comprises a first cylindrical plunger; and wherein said second plunger portion comprises an axially elongated cylindrical second plunger extending axially and centrally from the bottom of aid first plunger.

5. The apparatus as claimed in claim 1, wherein said port means is located proximate to the lower end of said first barrel.

6. The apparatus as claimed in claim 1, wherein said port means comprises a plurality of ports aligned along the axis of said first barrel, proximate to said first barrel's lower end.

7. The apparatus as claimed in claim 3, wherein said port means comprises a plurality of ports aligned along the axis of said first barrel, said plurality of ports are located so that at least one port remains unobstructed by said first plunger as said plunger descends, and said plurality of ports is always below said first surface.

8. The apparatus as claimed in claim 4, wherein aid port means comprises a plurality of ports aligned along the axis of said first barrel, said plurality of ports are located so that at least one port remains unobstructed by said first cylindrical plunger as said first cylindrical plunger descends, and said plurality of ports is always below said first surface.

9. In an underground well having a well casing leading from the surface to a fluid source and production tubing lowered into said casing; a reciprocating pump for pumping fluid from said casing to the surface by forming and moving a fluid column within said tubing by means of a reciprocating action, said pump comprising:

a first pump barrel coupled to said production tubing;

a second pump barrel having a smaller inside diameter than said first pump barrel's diameter;

means for coupling said second pump barrel to said first pump barrel so that said second pump barrel is co-axial with said first pump barrel;

plunger means which is reciprocated by said reciprocating action, said plunger means having a supporting surface which supports said fluid column as said supporting surface reciprocates sealably within said first pump barrel and a plunging surface which reciprocates sealably within said second pump barrel, wherein said supporting surface and said plunging surface reciprocate together;

port means for allowing fluid flow between said casing and said first barrel; and valve means cooperating with said plunger means for subjecting the plunging surface to the pressure exerted by the fluid in the casing during the upstroke and to the pressure exerted by the fluid column during the downstroke.

10. A pump as claimed in claim 9 wherein said port means is located on one of said first barrel, said second barrel, or said means or coupling such that the port means is always between he supporting surface and the plunging surface.

11. A pump as claimed in claim 9 wherein said port means comprises a plurality of ports aligned axially along said first barrel, said plurality of ports being located so that at least one port remains unobstructed by said plunger means as said plunger means descends, and said plurality of ports being always below said supporting surface.

12. A pump as claimed in claim 10 wherein said plunger means comprises a first plunger for reciprocating sealably within said first pump barrel, said first plunger comprising said supporting surface;

a second plunger for reciprocating sealably within said second pump barrel, said second plunger comprising said plunging surface;

means for connecting said first plunger and said second plunger so that the two plungers reciprocate together;

wherein said valve means comprises a standing valve associated with aid second barrel and a travelling valve associated with said plunger means.

13. The pump as claimed in claim 12, wherein said first plunger is provided with a first channel for allowing fluid to flow through the said first plunger, said second plunger is provided with a second channel for allowing fluid to flow through the said second plunger; said first and second channels linked by said means for connecting so that fluid can flow from one channel to the other.

14. The pump as claimed in claim 10, wherein said plunger means comprises a first cylindrical plunger portion for reciprocating sealably within said first pump barrel and comprises said supporting surface; and an axially elongated cylindrical second plunger portion extending centrally from the bottom of said first plunger portion for reciprocating sealably within said second pump barrel and comprises said plunging surface.

15. A pump as claimed in claim 11 wherein said plunger means comprises a first plunger for reciprocating sealably within said first pump barrel, said first plunger comprising said supporting surface;

a second plunger for reciprocating sealably within said second pump barrel, said second plunger comprising said plunging surface;

means for connecting said first plunger and said second plunger so that the two plungers reciprocate together;

wherein said valve means comprises a standing valve associated with said second barrel and a travelling valve associated with aid plunger means; and wherein said first plunger is provided with a first channel for allowing fluid to flow through the said first plunger, said second plunger is provided with a second channel for allowing fluid to flow through the said second plunger, said first and second channels being linked by said means for connecting so that fluid can flow from one channel to the other.

16. A method for pumping fluid from a well by forming and moving a fluid column within tubing which extends from a surface location to a location within the well, the apparatus of claim 1 being in fluid communication with said tubing at said location within the well, said method comprising the steps of:

applying a reciprocating action to the plunging means of said apparatus; and regulating, from the surface location, at least one of the pressure in the well at the location within the well, or the pressure of the fluid column in the tubing, in order to control the forces acting on said plunging means so as to assist in reciprocating said plunging means.

17. A method for pumping fluid from a well by forming and moving a fluid column within tubing which extends from a surface location to a location within the well, the pump of claim 9 being in fluid communication with said tubing at said location within the well, said method comprising the steps of:

applying a reciprocating action to the plunging means of said pump; and regulating, from the surface location, at least one of the pressure in the well at the location within the well, or the pressure of the fluid column in the tubing, in order to control the forces acting on said plunging means so as to assist in reciprocating said plunging means.

18. A method for pumping fluid from a well by forming and moving a fluid column within tubing which extends from surface location to a location within the well, the pump of claim 14 being in fluid communication with said tubing at said location within the well, said method comprising the steps of:

applying a reciprocating action to the plunging means of said pump; and regulating, from the surface location, at least one of the pressure in the well at the location within the well, or the pressure of the fluid column in the tubing, in order to control the forces acting on said plunging means so as to assist in reciprocating said plunging means.

19. A method for pumping fluid from a well by forming and moving a fluid column within tubing which extends from a surface location to a location within the well, the pump of claim 15 being in fluid communication with said tubing at said location within the well, said method comprising the steps of:

applying a reciprocating action to the plunging means of said pump; and regulating, from the surface location, at least one of the pressure in the well at the location within the well, or the pressure of the fluid column in the tubing, in order to control the forces acting on said plunging means so as to assist in reciprocating said plunging means.

20. A method for pumping fluid from a well by forming and moving a fluid column within tubing which extends from a surface location to a location within the well, the apparatus of claim 7 being in fluid communication with aid tubing at said location within the well, said method comprising the steps of:

applying a reciprocating action to the plunging means of said apparatus; and regulating, from the surface location, at least one of the pressure in the well at the location within the well, or the pressure of the fluid column in the tubing, in order to control the forces acting on said plunging means so as to assist in reciprocating said plunging means.

* * * * *